US010260698B2

(12) United States Patent
Björn et al.

(10) Patent No.: US 10,260,698 B2
(45) Date of Patent: Apr. 16, 2019

(54) HEADLAMP FOR VEHICLES HAVING AN OPTICAL UNIT WITH CORRUGATED PROFILING INCLUDING ARCHED PROJECTIONS AND ADJACENT ARCHED OUTLET SECTIONS FOR FORMING A LIGHT DISTRIBUTION PATTERN HAVING A LIGHT-DARK BOUNDARY

(71) Applicant: Hella KGaA Hueck & Co., Lippstadt (DE)

(72) Inventors: Dreßler Björn, Menden (DE); Fedosik Dmitry, Lippstadt (DE); Hagedorn Susanne, Lippstadt (DE); Kalze Franz-Josef, Harsewinkel (DE); Letzin Ronny, Lippstadt (DE); Stockfisch Andreas, Lippstadt (DE)

(73) Assignee: Hella GmbH & Co. KGaA, Lippstadt (DE)

( * ) Notice: Subject to any disclaimer, the term of this patent is extended or adjusted under 35 U.S.C. 154(b) by 154 days.

(21) Appl. No.: 14/946,891

(22) Filed: Nov. 20, 2015

(65) Prior Publication Data

US 2016/0169468 A1 Jun. 16, 2016

(30) Foreign Application Priority Data

Dec. 16, 2014 (DE) ..... 10 2014 118 745

(51) Int. Cl.
*F21S 41/26* (2018.01)
*F21S 41/275* (2018.01)
(Continued)

(52) U.S. Cl.
CPC ..... *F21S 41/275* (2018.01); *F21S 41/141* (2018.01); *F21S 41/26* (2018.01); *F21Y 2115/10* (2016.08)

(58) Field of Classification Search
USPC ..... 359/618–626; 362/333
See application file for complete search history.

(56) References Cited

U.S. PATENT DOCUMENTS

2008/0074896 A1* 3/2008 Ishida ..... F21S 48/1154 362/516
2009/0154185 A1* 6/2009 Yagi ..... F21S 48/1154 362/516

(Continued)

FOREIGN PATENT DOCUMENTS

DE 40 31 352 A1 4/1992
DE 10 2012 107 427 A1 5/2014

(Continued)

*Primary Examiner* — Jong-Suk (James) Lee
*Assistant Examiner* — Christopher E Dunay
(74) *Attorney, Agent, or Firm* — Husch Blackwell LLP

(57) ABSTRACT

A headlamp for vehicles including a light source and an optical unit for generating a specified light distribution pattern that has a light-dark boundary. The optical unit has a lens with a light inlet-side surface and a light outlet-side surface. Tlight inlet-side surface and/or the light outlet-side surface has optical elements in a sub-area. Corrugated profiling is provided as the optical elements. This profiling has at least one arched projection that transitions at opposing edges of this section continuously into arched outlet sections and/or into a main surface of the light inlet-side surface or the light outlet-side surface.

8 Claims, 2 Drawing Sheets

(51) Int. Cl.
*F21S 41/141* (2018.01)
*F21Y 115/10* (2016.01)

(56) References Cited

U.S. PATENT DOCUMENTS

| | | | | |
|---|---|---|---|---|
| 2013/0135887 | A1* | 5/2013 | Otani | B60Q 1/00 362/516 |
| 2016/0195243 | A1* | 7/2016 | Dross | F21V 7/0091 362/297 |
| 2016/0238207 | A1* | 8/2016 | Hsieh | F21S 48/1283 |
| 2017/0067610 | A1* | 3/2017 | Lo | F21S 48/1283 |

FOREIGN PATENT DOCUMENTS

| | | | | |
|---|---|---|---|---|
| EP | 2792938 | A2 * | 10/2014 | F21S 48/1159 |
| FR | 2 770 617 | A1 | 5/1999 | |

* cited by examiner

HEADLAMP FOR VEHICLES HAVING AN OPTICAL UNIT WITH CORRUGATED PROFILING INCLUDING ARCHED PROJECTIONS AND ADJACENT ARCHED OUTLET SECTIONS FOR FORMING A LIGHT DISTRIBUTION PATTERN HAVING A LIGHT-DARK BOUNDARY

CROSS REFERENCE

This application claims priority to German Application No. 10 2014 118745.8, filed Dec. 16, 2014, the entirety of which is hereby incorporated by reference.

FIELD OF TECHNOLOGY

The invention relates to a headlamp for vehicles comprising a light source and an optical unit for generating a specified light distribution pattern that has a light-dark boundary, wherein the optical unit has a lens with a light inlet-side surface and a light outlet-side surface, wherein the light inlet-side surface and/or the light outlet-side surface has optical elements in a sub-area.

BACKGROUND

From DE 10 2012 107 426 A1, a headlamp for vehicles with a light source and an optical unit for generating a specified light distribution pattern is known. The optical unit comprises a lens with a light inlet-side surface and a light outlet-side surface. Micro-optical elements are arranged as optical elements in a sub-area of the light inlet-side surface or the light outlet-side surface, wherein these optical elements deflect a part of the light beam emitted by the light source into an area above a light-dark boundary of the light distribution pattern in order to detect traffic signs placed high off the ground (overhead signs). Because the micro-optical elements have relatively small dimensions and extend uniformly over the relatively large sub-area of the light inlet-side surface or the light outlet-side surface, the micro-optical elements cannot be detected from the outside by an observer. One disadvantage in the known headlamp, however, is that the manufacturing costs to produce uniform micro-optical structures are relatively large.

SUMMARY OF THE INVENTION

Therefore, the task of the present invention is to improve a headlamp provided with a lens for vehicles such that different lighting requirements are fulfilled in a simple way, wherein, in particular, the manufacturing costs are limited or reduced.

To achieve this task, the invention is characterized in that a corrugated profiling is provided as the optical elements, wherein this corrugated profiling has at least one arched projection that transitions continuously into arched outlet sections and/or into a main surface of the light inlet-side surface or the light outlet-side surface on opposing edges of this arched projection.

According to the invention, a corrugated profiling that has at least one arched projection and preferably arched outlet sections running adjacent to this arched projection is provided in a sub-area of a light inlet-side surface and/or a light outlet-side surface of a lens of the optical unit. The projection here transitions continuously into the arched outlet sections. Therefore a continuous surface without any edges is created along the corrugations. Through the corrugated profiling, a scattering of part of the light beam emitted by the light source can be achieved in a simple way in terms of manufacturing. According to the arrangement of the corrugated profiling on the light inlet-side and light outlet-side surfaces of the lens, an additional light distribution pattern for detecting overhead traffic signs or for blurring a partial light beam can be realized in the area of the light-dark boundary.

According to one preferred embodiment of the invention, the arched projection of the corrugated profiling has a length that is greater than a length of the outlet section. Preferably, the length of the arched projection is greater than twice the length of the outlet section, so that the arched projection essentially defines the scattering of the light, while the outlet section enables only the continuous transition to another arched projection or to a main surface of the light inlet-side surface or light outlet-side surface.

According to one improvement of the invention, the sub-area of the light inlet-side surface is located in an area below the optical axis of the lens as sufficient luminous flux is present in a matching angular area. According to one improvement of the invention, the sub-area of the light outlet-side surface is located in an area close to an optical axis of the lens in which the light scattering is relatively minimal or simple angle changes can be performed.

According to one preferred embodiment of the invention, the corrugated profiling has only one arched projection that is located in the sub-area of the light inlet-side surface. The radius of the arched projection is formed such that a part of the light beam that is emitted by the light source and is incident on the arched projection is scattered so that it can be used in an area above a light-dark boundary of the light distribution pattern for detecting overhead traffic signs. The corrugated profiling is arranged on the light inlet-side surface of the lens that is arranged facing away from a cover lens of the headlamp.

According to one improvement of the invention, the arched outlet section has a single radius that is adjacent to the arched projection of the corrugated profiling for detecting overhead traffic signs. The outlet section enables a continuous transition to the main surface of the light inlet surface of the lens. This radius can also be easily produced by tools. The arched projections are designed so that the light is scattered upward in the vertical direction up to 6°.

According to one special embodiment of the invention, the corrugated profiling has at least two arched projections made from a sub-area of the light outlet-side surface of the lens, wherein these sections have a radius or length such that a part of the light beam that is emitted by the light source and is used for illumination at the light-dark boundary is scattered in the vertical direction. This can preferably blur the light/dark boundary, preferably causing scattering in the vertical direction of +/−0.1°. In this way, a relatively sharp transition in the area of the light-dark boundary can be blurred, which is realized by imaging an aperture edge when the headlamp is formed as a projection module.

According to one improvement of the invention, the radius of the outlet section is oriented in the opposite direction relative to the radius of the adjacent projection. In this way, the corrugated profiling can be produced in a simple way, for example, by means of a milling tool.

According to one improvement of the invention, the corrugated profiling extends at least from one lateral edge of the light inlet-side surface or the light outlet-side surface to an opposing lateral edge. This produces a symmetric surface structure for the lens with respect to a vertical center plane of the lens. The lens surface thus has a relatively homogeneous structure.

BRIEF DESCRIPTION OF THE DRAWINGS

Reference is now made more particularly to the drawings, which illustrate the best presently known mode of carrying out the invention and wherein similar reference characters indicate the same parts throughout the views.

DETAILED DESCRIPTION OF THE DRAWINGS

Figure 1:
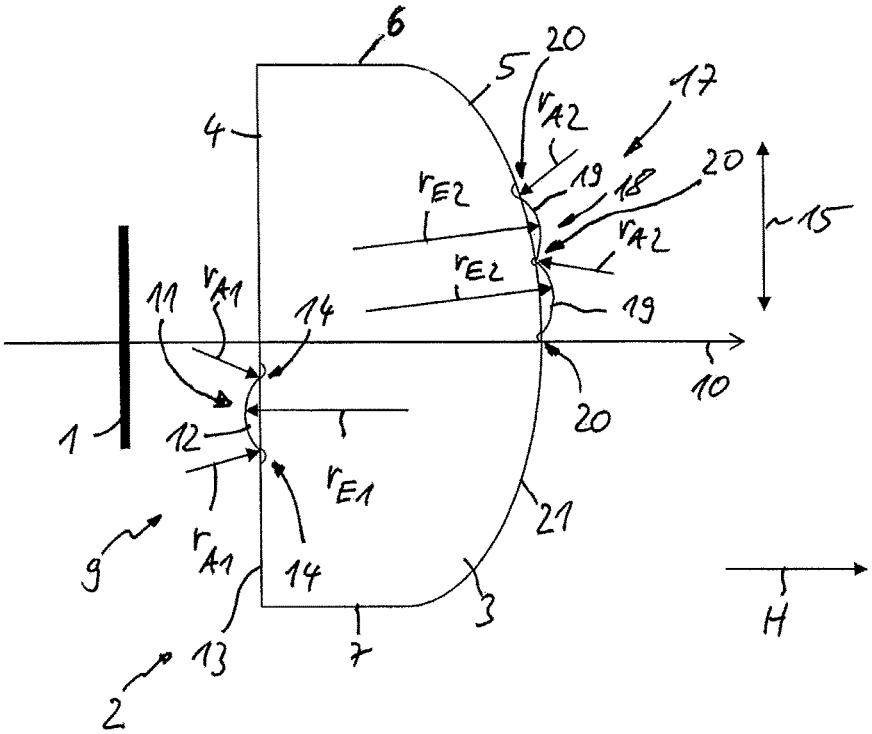
FIG. 1 is a side view of a headlamp with a corrugated profiling on a light inlet-side surface and a light outlet-side surface of a lens.

A headlamp for vehicles is used for generating a specified light distribution pattern, for example, a low-beam light pattern or a high-beam light pattern. The headlamp according to a first embodiment of the invention according to FIGS. 1 to 3 has a light source 1 and an optical unit 2, wherein the optical unit 2 is formed just by a lens 3. The light source 1 consists of one or more semiconductor-based light elements, for example, LED light elements that are arranged on a carrier or a printed circuit board.

The lens 3 formed as a plano-convex lens is arranged in the main emission H in front of the light source 1. The lens 3 preferably has a symmetric shape relative to a vertical center plane. The lens 3 has a light inlet-side surface 4 that is arranged on a side of the lens 3 facing the light source 1. The lens 3 also has a light outlet-side surface 5 that is arranged on a side of the lens 3 facing away from the light source 1 or on a side facing a not-shown cover lens of the headlamp. The lens 3 also has a top surface 6 and a base surface 7 that are arranged opposite each other and connect the light inlet-side surface 4 and the light outlet-side surface 5 to each other on the top and bottom sides. The lens 3 also has opposing, preferably vertical side surfaces 8, 8' that connect the light inlet-side surface 4 and the light outlet-side surface 5.

In one sub-area 9 of the light inlet-side surface 4 that is arranged in an area close to an optical axis 10 of the lens 3 and below the optical axis 10, there is a corrugated profiling 11 for generating a light beam, by means of which overhead traffic signs can be detected. The corrugated profiling 11 has a single arched projection 12 that is formed raised relative to a flat main surface 13 of the light inlet-side surface 4. An arched outlet section 14 whose free end transitions continuously into the main surface 13 is adjacent to both sides of the arched projection 12, that is, at an upper edge and a lower edge of this arched projection. Thus, on the light inlet-side surface 4, a direction of corrugation 15 is produced that runs in the vertical direction or perpendicular to the optical axis 10. The arched projection 12 transitions continuously into the adjacent arched outlet sections 14.

The arched projection 12 has a length $I_{E1}$ that is greater than a length $_{IA1}$ of the outlet section 14. Preferably, the length $I_{E1}$ of the arched projection 12 is more than twice as large as the length $I_{A1}$ of the outlet section 14, see FIG. 2. The length $I_{E1}$ of the arched projection 12 is in a range between 0.8 mm and 1.2 mm. Preferably, the arched projection 12 has a length $I_{E1}$ of 1 mm.

The corrugated profiling 11 or the arched projection 12 or the arched outlet sections 14 are arranged in a straight line perpendicular to the direction of corrugation 11 and extending continuously in the horizontal direction. The corrugated profiling 11 extends from a lateral edge 16 of the light inlet-side surface 4 to an opposing lateral edge 16' of this surface. Preferably, the corrugated profiling 11 continues beyond the lateral edge 16, 16' into a sub-area of the side surfaces 8, 8'.

The arched projection 12 has a radius $r_{E1}$ in a range from 0.5 mm to 2 mm. Preferably, the radius $r_{E1}$ of the projection 12 is 1.3 mm. The outlet section 14 has a radius $r_{A1}$ in a range from 0.08 mm to 0.12 mm. Preferably, the radius $r_{A1}$ of the outlet section 14 is 0.1 mm. For example, the radius ($r_{A1}$) of the outlet section 14 of the corrugated profiling 11 on one side of the arched projection 12 is not equal to the radius $r_{A1}$ of the outlet section 14 of the corrugated profiling 11 on the opposing other side of the arched projection 12.

The radius $r_{A1}$ outlet section 14 is oriented opposite the radius $r_{E1}$ of the projection 12. This produces a continuous and constant corrugated profiling 11 between opposing edges adjacent to the main surface 13 of the light inlet-side surface 4.

The corrugated profiling 11 thus allows part of the light beam emitted by the light source 1 to be scattered upward in the vertical direction up to 6°. In this way, the part of the light beam incident on the corrugated profiling 11 is directed into an area above a light-dark boundary of the light distribution pattern, which enables the detection of overhead traffic signs.

The light outlet-side surface 5 has, in a sub-area 17 that is arranged above the optical axis 10 and in an area close to the optical axis 10, a corrugated profiling 18 for blurring a light beam of the light source 1 by +/−0.1° in the area of the light-dark boundary of the light distribution pattern. To do this, the corrugated profiling 18 has two arched projections 19 that are connected to each other by means of an arched outlet section 20 and transition into a main surface 21 of the light outlet-side surface 5 by means of the same outlet section 20.

The corrugated profiling 18 runs in the vertical direction, that is, in the direction of corrugation 15, continuously, i.e., without any edges. The corrugated profiling 18—like the corrugated profiling 11 of the light inlet-side surface 4—also has no straight or flat contours in the direction of corrugation 15.

In the horizontal direction, the corrugated profiling 18 runs continuously or in a straight line or following the contour of the convex light outlet-side surface 5 from the side surface 8 to the opposing side surface 8'. Preferably, the corrugated profiling 18 extends over a lateral edge 22, 22' of the light outlet-side surface 5 into a sub-area of the side surfaces 8, 8'. For example, the corrugated profiling 18 can run on the side surfaces 8, 8' up to a vertical plane at which the corrugated profiling 11 for detecting the overhead traffic signs also ends.

The arched projection 19 has a length $I_{E2}$ that is greater than a length $I_{A2}$ of the outlet section 20. Preferably, the length $I_{E2}$ of the arched projection 19 is greater than twice the length $I_{A2}$ of the outlet section 20.

The length $I_{E2}$ of the arched projection 19 can be in a range from 1.2 mm to 1.8 mm. Preferably, the length $I_{E2}$ of the arched projection 8 is 1.5 mm.

The arched projection 19 has a radius $r_{E2}$ in a range from 0.5 mm to 30 mm. Preferably, the radius $r_{E2}$ of the arched projection 19 can be approx. 23 mm.

The outlet section 20 has a radius $r_{A2}$ in a range from 0.5 mm to 350 mm. Preferably, the radius $r_{A2}$ of the outlet section 20 of the corrugated profiling 18 on one side of the arched projection 19 is not equal to the radius $r_{A2}$ of the outlet section 20 of the corrugated profiling 18 on the opposing side of the arched projection 19. The outlet sections 20 adjacent to the arched projection 19 thus have different curvatures. The transition radii $r_{A2}$ can transition differently into the aspherical surface 5.

The radius $r_{A2}$ is oriented in the opposite direction relative to the radius $r_{E2}$ of the arched projection 19, so that a continuous or constant transition from the arched projection 19 to the next arched projection 19 or to the main surface 21 of the light outlet-side surface 5 is realized.

The outlet sections 20 and the projections 19 each have identical forms, respectively.

The lens 3 preferably consists of a plastic material, for example, PMMA.

The corrugated profiling sections 11, 18 form a ribbed structure in the vertical direction.

Figure 2:
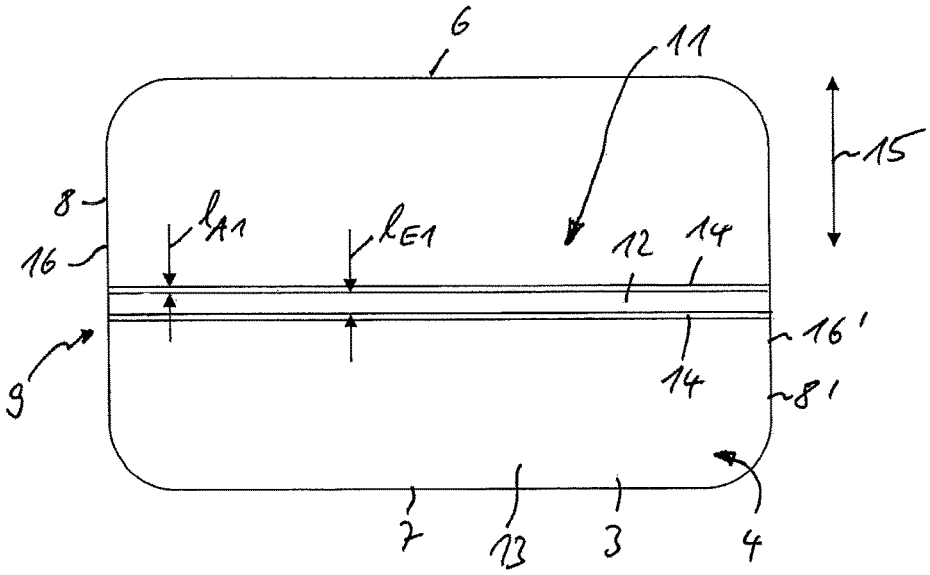
FIG. 2 is a rear view of the lens with the corrugated profiling on the light inlet-side surface.
Figure 3:
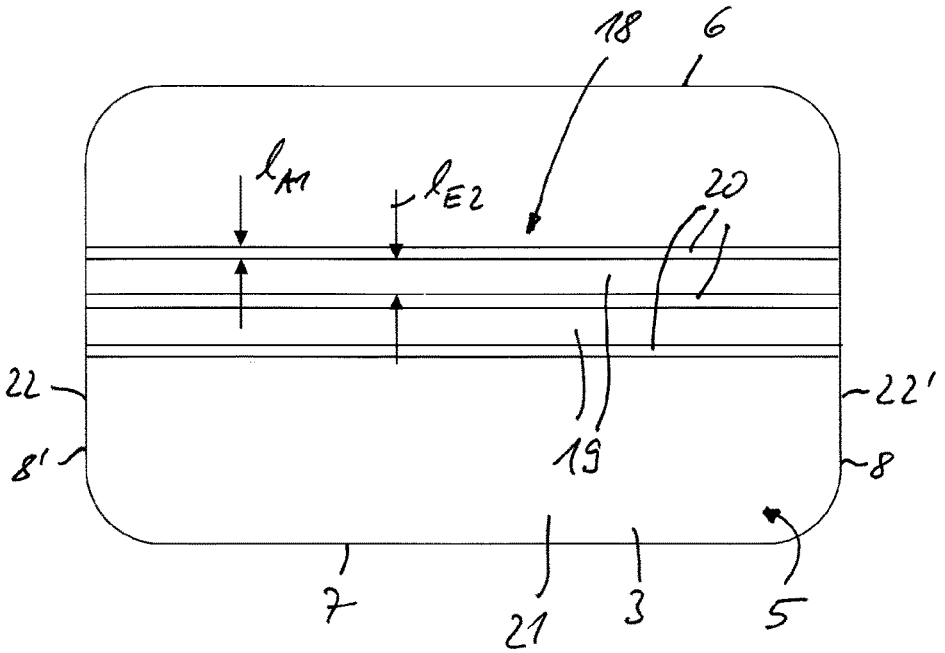
FIG. 3 is a front view of the lens with the corrugated profiling on the light outlet-side surface.

According to a not-shown embodiment of the invention, the corrugated profiling sections 11, 18 can also have more than the projections 12, 19 or arched outlet sections 14, 20 shown in FIGS. 1 to 3. It is essential that the arched outlet sections 14, 20 connect on both sides directly to the projections 12, 19.

Optionally, the transition from the corrugated profiling 11, 18 to the main surface 13, 21 of the light inlet-side surface 4 or the light outlet-side surface 5 can also be realized without outlet section 14, 20 if the main surface 13, 21 has a corresponding curvature. In this case, the transition is realized directly from the projection 12, 19 to the main surface 13, 21.

According to another not-shown embodiment of the invention, the headlamp can be formed as a projection module, wherein the projection module also has a reflector and an aperture with an aperture edge that is imaged by means of the lens 3 at the light-dark boundary of the light distribution pattern.

According to another not-shown embodiment of the invention, the lens 3 can also have either only the corrugated profiling 11 or only the corrugated profiling 18.

LIST OF REFERENCE SYMBOLS

1 Light source
2 Optical unit
3 Lens
4 Light inlet-side surface
5 Light outlet-side surface
6 Top surface
7 Base surface
8,8' Side surfaces
9 Sub-area
10 Optical axis
11 Corrugated profiling
12 Arched projection
13 Main surface
14 Arched outlet section
15 Direction of corrugation
16,16' Lateral edge
17 Sub-area
18 Corrugated profiling
19 Arched projection
20 Arched outlet section
21 Main surface
22,22' Lateral edge
$I_{E1}$, $I_{A1}$, $I_{E2}$, $I_{A2}$ Length
H Main emission
$r_{E1}$, $r_{A1}$ Radius

The invention claimed is:

1. A headlamp for vehicles comprising:

a light source;

an optical unit positioned in front of the light source for generating a specified light distribution pattern that has a light-dark boundary, said optical unit including a lens with a light inlet-side surface and with a light outlet-side surface;

a corrugated profiling optical element, said corrugated profiling optical element including:

at least one arched projection that includes opposing upper and lower edges and a convex first radius;

a first arched outlet section adjacent to the upper edge of the at least one arched projection having a concave second radius running in a direction opposite the first radius;

a second arched outlet section adjacent to the lower edge of the at least one arched projection having the second radius; and a main surface of the light inlet-side surface or the light outlet-side surface adjacent to each of the first arched outlet section and the second arched outlet section.

2. The headlamp according to claim 1, wherein the at least one arched projection has a length that is greater than a length of at least one of the first arched outlet section and the second arched outlet section.

3. The headlamp according to claim 1 wherein the corrugated profiling optical element of at least one of the light inlet-side surface and the light outlet-side surface is located in an area close to an optical axis of the lens.

4. The headlamp according claim 1 wherein the corrugated profiling optical element has a single arched projection that is arranged in an area close to an optical axis of the lens of the light inlet-side surface and has a radius and a length such that a part of the light beam emitted by the light source is directed into an area above a light-dark boundary of the light distribution pattern in order to detect traffic signs placed high off the ground.

5. The headlamp according to claim 4, wherein the first and second outlet sections of the corrugated profiling optical element each have a single radius.

6. The headlamp according claim 1 wherein the corrugated profiling optical element has at least two arched projections that are arranged in an area close to an optical axis of the lens of the light outlet-side surface and each of which has a radius and a length such that a part of the light beam emitted by the light source, by means of which the light-dark boundary is formed, is scattered in the vertical direction.

7. The headlamp according to claim 6, wherein the first and second outlet sections of the corrugated profiling optical element have a single radius, wherein the radius of at least one of the first and second outlet sections of the corrugated profiling optical element running on one side of the arched projection is not equal to the radius of the other of the first and second outlet sections of the corrugated profiling running optical element on an opposing side of the arched projection.

8. The headlamp according claim 1 wherein the corrugated profiling optical element extends continuously at least from one lateral edge of the light inlet-side surface and the light outlet-side surface to an opposing lateral edge of the light inlet-side surface and the light outlet-side surface, respectively.

* * * * *